US006497266B1

(12) United States Patent
Palmer et al.

(10) Patent No.: US 6,497,266 B1
(45) Date of Patent: Dec. 24, 2002

(54) WINDOW COVERING SLAT

(75) Inventors: Roger Palmer, Greensboro, NC (US); Randy Ferrie, Elkhard, IN (US)

(73) Assignee: Newell Window Furnishings, Freeport, IL (US)

( * ) Notice: Subject to any disclaimer, the term of this patent is extended or adjusted under 35 U.S.C. 154(b) by 0 days.

(21) Appl. No.: 09/593,843

(22) Filed: Jun. 14, 2000

(51) Int. Cl.[7] ..... E06B 9/00

(52) U.S. Cl. ..... 160/236; 160/178.1 R; 156/308.2; 156/308.4

(58) Field of Search ..... 160/236, 178.1 R, 160/178.1 V, 900; 156/218, 626, 308.2, 308.4

(56) References Cited

U.S. PATENT DOCUMENTS

| | | | | |
|---|---|---|---|---|
| 1,937,342 A | | 11/1933 | Higbie | |
| 2,121,217 A | | 6/1938 | Ellis | 156/17 |
| 2,123,010 A | | 7/1938 | Kahn | 156/17 |
| 2,326,454 A | | 8/1943 | Gentile | |
| 2,590,204 A | | 3/1952 | Phillips | 160/236 |
| 2,855,039 A | | 10/1958 | Gross | |
| 3,472,305 A | | 10/1969 | Lefes | 160/236 |
| 4,154,889 A | | 5/1979 | Platt | 428/234 |
| 4,309,472 A | | 1/1982 | Götting et al. | 428/224 |
| 4,352,384 A | * | 10/1982 | McCoy, Jr. | |
| 4,490,425 A | | 12/1984 | Knoke et al. | 428/90 |
| 4,519,435 A | | 5/1985 | Stier | 160/166 A |
| 4,818,590 A | | 4/1989 | Prince et al. | |
| 5,049,424 A | | 9/1991 | Carden et al. | |
| 5,101,876 A | | 4/1992 | Zak | 160/236 |
| 5,141,042 A | | 8/1992 | Schwaegerle | 160/236 |
| 5,163,951 A | | 11/1992 | Pinchuk et al. | |
| 5,273,781 A | | 12/1993 | Shu | 427/176 |
| 5,297,607 A | | 3/1994 | Beauchamp | |
| 5,303,507 A | | 4/1994 | Oille | |
| 5,355,928 A | | 10/1994 | Robertson | |
| 5,466,516 A | | 11/1995 | Lutzow et al. | 428/282 |
| 5,482,100 A | | 1/1996 | Kuhar | 160/170 |
| 5,531,257 A | | 7/1996 | Kuhar | 160/168.1 |
| 5,593,768 A | | 1/1997 | Gessner | 160/236 |
| 5,601,132 A | | 2/1997 | Goodman | 160/236 |
| 5,603,369 A | * | 2/1997 | Colson et al. | |
| 5,749,404 A | | 5/1998 | Colson | |
| 5,797,442 A | | 8/1998 | Colson et al. | 160/236 |
| 5,845,690 A | | 12/1998 | Colson et al. | |
| 5,897,731 A | | 4/1999 | Colson et al. | 156/197 |
| 5,960,850 A | | 10/1999 | Colson et al. | 160/236 |
| 6,153,283 A | * | 11/2000 | Pierson et al. | |

FOREIGN PATENT DOCUMENTS

| | | | |
|---|---|---|---|
| EP | 0 692 602 A1 | 1/1996 | E06B/9/262 |
| WO | WO 96/35881 | 11/1996 | F06B/9/386 |

* cited by examiner

*Primary Examiner*—Blair M. Johnson
(74) *Attorney, Agent, or Firm*—Marshall, Gerstein & Borun

(57) ABSTRACT

A window covering includes a plurality of slats, each slat including a slat base derived from a felt batt and, in one preferred embodiment, a fabric layer. The slat base is thermally treated to form a polymer matrix and can be molded into any desired shape. The starting felt batt includes at least two types of thermoplastic fibers, one having a lower melting point than the other. The thermal forming includes heating the felt batt to a temperature sufficient to melt the lower melting fibers to form a polymer matrix which at least partially envelops the fibers of the higher melting component. A method of fabricating a slat for a window covering is also disclosed. In its most basic form the method includes the steps of thermally forming the slat base and molding it into the desired shape. The optional step of securing a layer of fabric to the slat base is also disclosed.

21 Claims, 2 Drawing Sheets

FIG. 5
FIG. 1
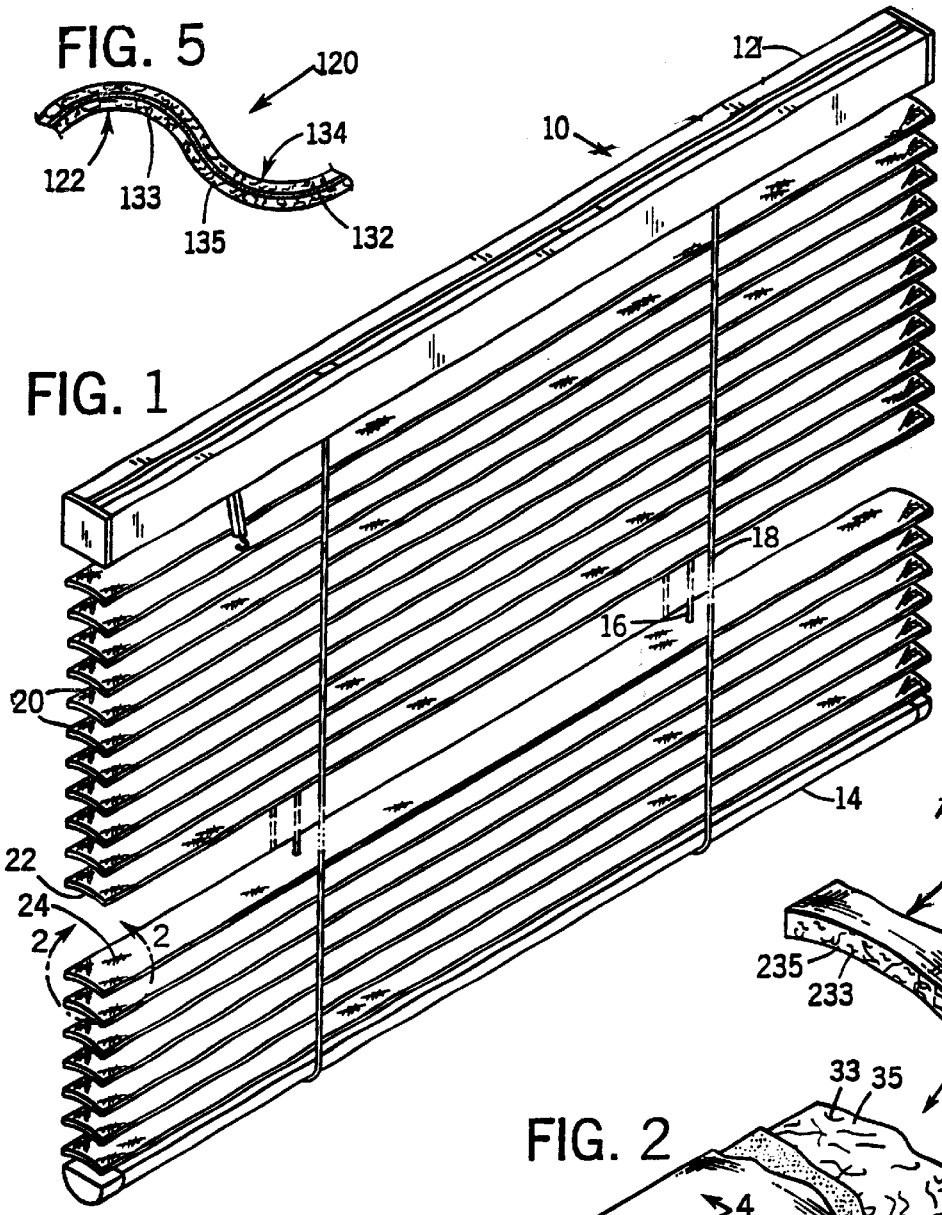
FIG 7
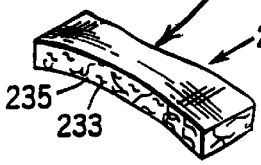
FIG. 2
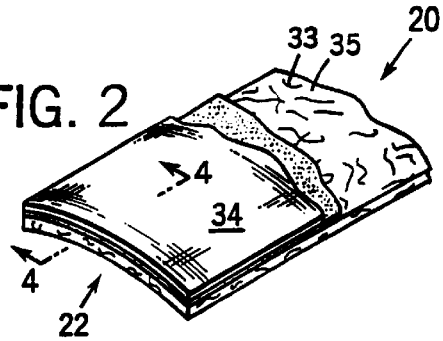
FIG. 4A
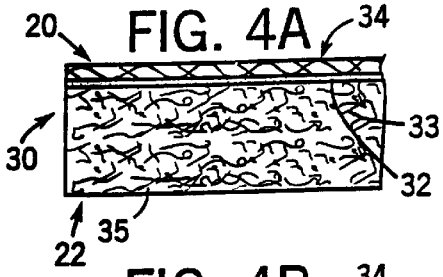
FIG. 3
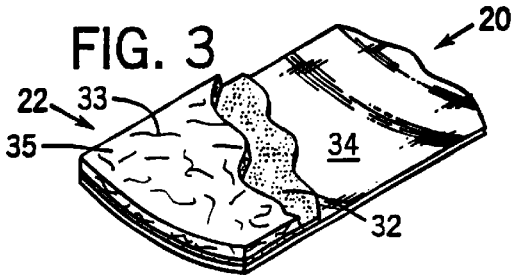
FIG. 4B
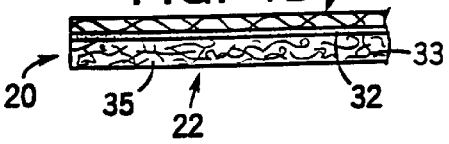

WINDOW COVERING SLAT

BACKGROUND OF THE INVENTION

1. Field of the Invention

The present invention relates generally to window coverings that include horizontally or vertically disposed slats. It relates particularly to a slat made from a multi-component starting felt batt and to various uses of the slat, as is, or as a base for a fabric covering.

2. Description of the Prior Art

Window coverings (e.g., blinds having vertically or horizontally disposed slats) generally employ slats fabricated of rigid materials such as metal, plastic, or wood. While these materials may each provide certain advantages, they all have hard surfaces and reflect, rather than absorb, sound. They are also hard to the touch, and do not have an aesthetically pleasing finish when compared to the "soft" fabric window coverings, such as pleated, cellular or Roman shade products. Moreover, rigid slats cannot generally be repaired if deformed to the point that they crease, crack or break. Such damage may occur when, for example, a person manually spreads apart the slats to look through a blind.

It is known to provide vertical blinds having slats comprised of strips of textile material, some of which comprise a backing and a facing. The edges of the facing may be rearwardly inturned, and the edges of the backing may be forwardly inturned, so that the backing and the facing may be secured to each other. See U.S. Pat. No. 4,519,435, issued May 28, 1985 to Stier and entitled "Slats For Venetian Blinds". It is also known to provide vertical blinds covered with fabric suitable for making clothing or drapes, the fabric being attached to a backing member by either sewing or a heat bonding process. See U.S. Pat. No. 5,061,132 issued Feb. 11, 1997 to Goodman for "Vertical Blinds And Method For Making The Same". It is further known to produce slats from linear, synthetic polyester fibers, which serve as protection against light, and which have been stiffened permanently by plastification. See U.S. Pat. No. 4,309,472 issued Jan. 5, 1982 to Gotting, et al. for "Slats Serving As Protection Against Light". It is also known to make blind fabric utilizing natural or synthetic fibers of fabric as base materials to form an inexpensive fabric used in conjunction with conventional venetian and vertical blinds and formed by a method comprising dipping, compressing, tentering, slitting into desired widths, heating, and forming. See U.S. Pat. No. 5,273,781 issued Dec. 28, 1993 to Shu for "Method Of Making Blind Fabrics". Another know slat adds a tape or sheet of sound deadening material to a conventional slat. See U.S. Pat. No. 3,472,305 issued Oct. 14, 1969 to Lefes for "Soundproof And Heatproof Slat For Venetian Blinds". All such slat configurations preceding the present invention have one or more disadvantages, generally relating to manufacturing cost, lack of ability to absorb sound, and/or the absence of a soft fabric look and feel.

Other slats which include components other than a single piece of slat material, are described in U.S. Pat. No. 2,121,217 issued Jun. 21, 1938 to Ellis for "Venetian Blind Slat"; U.S. Pat. No. 2,123,010 issued Jul. 5, 1938 to Kahn for "Venetian Blind"; U.S. Pat. No. 2,590,204 issued Mar. 25, 1952 to Phillips for "Acoustical Venetian Blind"; U.S. Pat. No. 5,101,876 issued Apr. 7, 1992 to Zak for "Louver Covering System"; and U.S. Pat. No. 5,141,042 issued Aug. 25, 1992 to Schwaegerle for "Web Covered Vertical Blind Slat Assemblies".

The art of producing non-woven felts is also well-developed. For example, it is known that non-woven fabrics may be "needled" to substrates or to other layers of non-woven fabric to attach the two together. See, for example U.S. Pat. No. 4,154,889 issued May 15, 1979 to Platt for "Non-Woven Fabric, Method And Apparatus For Its Manufacture" and U.S. Pat. No. 4,490,425 issued Dec. 25, 1984 to Knoke, et al. for "Fused And Needled Non-Woven Interlining Fabric". A three layer laminate which includes a layer of meltblown fibers between two layers of needle punched fibers, the three layers being ultrasonically welded together, is shown in U.S. Pat. No. 5,466,516 issued Nov. 14, 1995 to Lutzow, et al. for "Thermoplastic Fiber Laminate". Furthermore, the use of felts comprising at least two different thermoplastic polymers having different melting points is known, as illustrated in U.S. Pat. No. 5,593,768 issued Jan. 14, 1997 to Gessner for "Non-Woven Fabrics And Fabric Laminates From Multi Constituent Fibers".

It would be advantageous to provide a window covering slat which is economical to manufacture, provides the pleasant appearance of a soft-textured fabric, and which absorbs sound. It would also be advantageous to provide a window covering slat which does not dent or readily crease and which is easily repaired should it nonetheless become damaged in this way.

FEATURES AND SUMMARY OF THE INVENTION

A feature of the present invention is to provide a window covering which includes a plurality of slats, each slat including a layer formed from a felt batt, and which may, in some embodiments, include a second layer of fabric secured to a slat base.

Another feature of the present invention is to provide a slat for a window covering which includes a plurality of slats, each slat including a slat base thermally formed to a predetermined shape from a felt batt.

Yet another feature of the invention is a method of fabricating a slat for a window covering, the method including the steps of thermally forming a slat base from a felt batt, and optionally securing a layer of fabric to the slat base.

A different feature of the present invention is to provide a slat for window coverings, including horizontal and vertical blinds, which may be made in a variety of cross-sectional shapes, including rectangular, S-shaped, curled, and the like.

A still further feature of the present invention is to provide a slat for window coverings which displays a different appearance on one side than on the other, e.g. a decorative appearance on one side and a functional appearance on the other side.

A still further feature of the present invention is to provide a slat for window coverings in which a fabric applied to a slat base may be selected from woven, non-woven, synthetic or natural fabrics.

How the foregoing and other features of the present invention are accomplished, individually or in combination, will be described in the following detailed description of certain preferred embodiments, taken in conjunction with the drawings. Generally, however, the features are accomplished by forming a slat base into a desired shape from a felt batt and optionally applying a fabric layer thereover. The fabric may be woven, non-woven, synthetic or natural and, when used, is selected primarily for its aesthetic properties. The felt batt is preferably composed of at least two types of thermoplastic fibers having different melting points and is thermally treated at a temperature above the melting point of the fiber having the lower melting point to form a polymer matrix which at least partially envelopes the higher melting point fibers. The felt batt is compressed when heated and formed into its desired shape. A fabric may be attached to the slat before or after such thermal treatment, and the thermal treatment step can be carried out in a mold to simultaneously form the slat into its desired form. Alternatively, the slat, after an initial thermal treatment, can be placed into a mold and be re-heated to form the desired final shape. Other ways in which the above-referenced and other features of the present invention are accomplished individually or in various combinations will become apparent to those skilled in the art after they have read this specification, and such other ways are deemed to fall within the scope of the present invention if they fall within the scope of the claims which follow.

DESCRIPTION OF THE DRAWINGS

A full understanding of the invention may be gained from the appended drawings, taken in conjunction with the detailed description below. Like reference numerals are used to refer to like components.

FIG. 1 is a broken perspective view of a preferred embodiment of a window covering including a plurality of slats made according to the present invention;

FIG. 2 is a fragmentary, broken-away perspective top view of a single slat taken generally at line 2—2 of FIG. 1;

FIG. 3 is a fragmentary, broken-away perspective bottom view of the slat of FIG. 2;

FIG. 4A is a fragmentated, sectional elevational view of a portion of a slat before thermal treatment;

FIG. 4B is a fragmentated sectional elevation taken at line 4—4 at FIG. 2;

FIG. 5 is a sectional view taken across an S-shaped slat and illustrating how the present invention is applied to slats of different configurations;

FIG. 7 is a broken-away perspective of a slat made according to the present invention, without the addition of a covering fabric layer;

DETAILED DESCRIPTION OF THE PREFERRED EMBODIMENTS OF THE PRESENT INVENTION

Before proceeding to a description of the preferred embodiments of the present invention, several general comments can be made about the applicability and the scope thereof.

Figure 6:
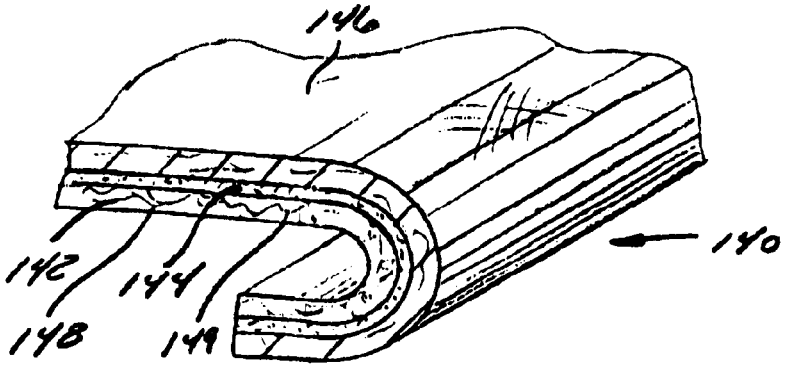
FIG. 6 is a perspective view of the end of a slat illustrating another slat shape especially useful for light blocking applications.

First, the drawings illustrate three slat configurations, one gently curved, as shown in FIGS. 1–3, 7 and 8A and 8B, an S-shaped configuration as shown in FIG. 5 and a curled configuration shown in FIG. 6. These are come of the preferred configurations useful for horizontal and/or vertical blinds, but other slat shapes are shown in the art discussed above and in other art known to those skilled in the window covering field. The present invention is applicable to many different slat shapes.

Second, while the present invention shows and illustrates the use of an adhesive to bond a fabric to a slat base prepared from a felt batt (hereinafter "slat base"), other attachment techniques, such as ultrasonic welding, sewing, etc. can all be employed, depending upon the size, space requirements and aesthetic requirements of the particular window covering.

Third, the fabric, if used, may be natural (e.g. silk, cotton, wool, linen and the like), or synthetic, and the fabric may be treated with known fire retardants, stain or water repellants, dust repellants, UV light stabilizers, etc.

Fourth, the weave of the fabric can vary widely, i.e. it can be woven or non-woven, since the dimensional stability thereof is controlled by bonding it to the slat base. Moreover, the color and pattern of the fabric can be selected from any known in the art.

Fifth, the illustrated slat base is prepared from a felt batt, but the felt can be selected from a wide range of thicknesses, felt compositions, colors and the like. For example, the felt batt may include three or more kinds of fibers, some of which may not be thermoplastic. Usually, the slat base will be light in color to reflect light outwardly when the window covering is in a closed position, a feature which, in and of itself, is well-known to the horizontal and vertical blind art. However, in other situations, the color of any fabric layer may match, contrast or be compatible with the color of the slat base.

Sixth, the hardware used to mount the slats can be selected from any hardware system known in the art, including those using lift and ladder cords, hanger systems for vertical blinds, balanced cordless systems, etc.

Seventh, the preferred and illustrated technique for forming a two layer slat of the present invention is to attach a fabric layer to a slat base before the latter is thermally treated for rigidity and compression. However, the present invention may also be practiced by thermally preparing and forming the slat base into its desired shape before the application of the fabric layer. The latter method provides the ability to have the fabric layer cover the front and back edges of the slat base. Other end or edge treatments may also be employed, such as those illustrated in FIGS. 8A and 8B.

Finally, while a fabric covered slat base is shown in several of the FIGURES, the present invention contemplates using the thermal forming of a two (or more) component felt batt for preparing a slat which may be used by itself or which may be direct printed or otherwise decorated for the final window covering product.

Proceeding now to the detailed description of the preferred embodiments of the present invention, FIG. 1 shows a window covering 10 including a plurality of slats 20. In the illustrated embodiment, window covering 10 is shown as a venetian or mini-blind. Window covering 10 includes a conventional head rail 12, bottom rail 14, lift cords 16, and ladder cords 18 for supporting and tilting slats 20.

FIGS. 2, 3, and 4B show one preferred embodiment of finished slat 20. Slat 20 includes a slat base 22 prepared from felt batt 30 (as described in greater detail below in connection with FIGS. 4A and 7), an upper fabric layer 34, and an intermediate bonding layer 32 which, for purposes of this description, can be considered an adhesive. In a particularly preferred embodiment, slat base 22 is configured of randomly oriented polymer strands 33 in a polymer matrix 35.

In this illustrated embodiment, slat base 22 (see FIG. 4A) begins as a felt batt 30, typically approximately 0.25 inches thick, comprising randomly oriented thermoplastic (e.g. polyester) fibers. A first portion of the fibers 33 has a first and higher melting point (e.g., 460° F.) (termed "high-melt" fibers 33 hereinafter), and a second portion of the fibers 31 has a second and lower melting point (e.g., 350° F. or below) (termed "low-melt" fibers 31 hereinafter). The melting point range of the low-melt fibers 31 is preferably approximately 200° F. to 350° F. Fabric layer 34 preferably includes only materials which are not affected by temperatures as high as the upper end of the melting point range of the low-melt fibers 31, at least in the case where fabric layer 34 is applied prior to thermal forming of the slat base 22.

The FIGURES also show the bonding layer 32 securing fabric layer 34 to slat base 22. In a preferred embodiment, bonding layer 32 comprises an adhesive web, but as mentioned above, other types of adhesives and bonding techniques can be used. If the adhesive is a hot melt adhesive it should have a melting point which is below the melting point of high-melt fibers 33. In a particularly preferred embodiment, the adhesive is a thermoplastic adhesive web available from Bostick, of Middelton, Mass., under product code PE120. This web has a melting point of about 280° F. to 325° F.

Production of slats 20 requires the application of heat and pressure. When placed in a mold or form having the desired final cross-section of slat 20 (e.g., a mold having an upper concave shape and a lower convex shape) and when heated to at least to the melting point of low-melt fibers 31, the low-melt 31 will soften and flow sufficiently to at least partially envelop the high-melt fibers 33 in a polymer matrix 35. Upon cooling, the low-melt material in slat base 22 is no longer fibrous or is at least less fibrous than in the initial batt 30 and is hence relatively stiff and inflexible. Further, the polymer matrix 35 binds the high-melt fibers 33, inhibiting movement of the high-melt fibers 33 relative to each other.

The degree of stiffening that occurs is a function of the proportion of low-melt fibers 31 to high-melt fibers 33. In our development and evaluation work, we have found that a mixture of 30% low-melt fibers 31 and 70% high-melt fibers 33 provides a slat 20 having an optimal combination of stiffness, strength, shape memory, as well as a desirable appearance, texture and economy of manufacture. Different proportions of low-melt fibers 31 (e.g. 20%–50%) result in slats 20 which in have different engineered properties that may be utilized for particular applications. The preferred batt 30 having 30% low-melt fibers 31 melting at 230° F. and 30% high melt fibers 33 melting at 480° F. is available from the Felters Group of Roebuck, S.C. 29376.

Fabric layer 34 is not appreciably affected by the heat and pressure applied to slat base 22. Slat 20 is thus stiffened by the change in form of the low-melt fibers 31, from fibers to at least a partially fused, solid plastic matrix 35. The application of pressure to the mold or form will insure that the softened or melted low-melt fibers 31 flow evenly to at least partially envelop and bond to high-melt fibers 33.

One production process for slats 20 utilizes a die (not shown) having separable lower and upper portions provided with facing surfaces having convex and concave (respectively) shapes, matching the slight curve of slat 20 seen in FIGS. 2 and 3. Felt batt 30 is placed upon the lower portion and adhesive 32 is placed thereover. Fabric layer 34 is then laid over adhesive 32. The upper portion of the die is then placed over the sandwich, and a clamping system (e.g., one or more hydraulic cylinders) forces the upper portion of the die toward the lower portion thereof, thereby compressing the felt batt 30 and forcing fabric layer 34, adhesive 32, and slat base 22 together. Heat is applied at a temperature and for a time sufficient to at least partially soften or melt the low-melt fibers 31 to form polymer matrix 35 about the still solid hot-melt fibers 33. Slat 20 after cooling may be removed from the die, and, if necessary, trimmed to size and punched with any desired apertures; e.g., to accommodate lift cords 16 in window covering 10.

A preferred method for forming slats 20 includes obtaining or producing felt batt 30, adhesive 32, and fabric 34 in coiled rolls; passing these materials (in the relationship shown in FIGS. 2, 3, and 4A) into feed rolls of a thermal processing machine (e.g., a transfer printer or a laminator); and simultaneously applying the desired amount of heat and pressure. Application of heat causes the adhesive 32 and/or the low-melt fibers to soften and/or melt. Cooling provides a laminate, which can then be rolled up for further processing.

Figure 8A:
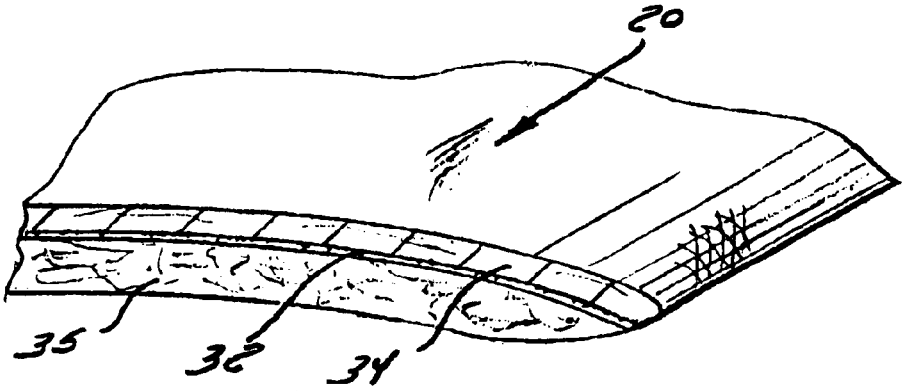
FIG. 8A is a fragmentary perspective view of the end of a slat and illustrating an edge finish.
Figure 8B:
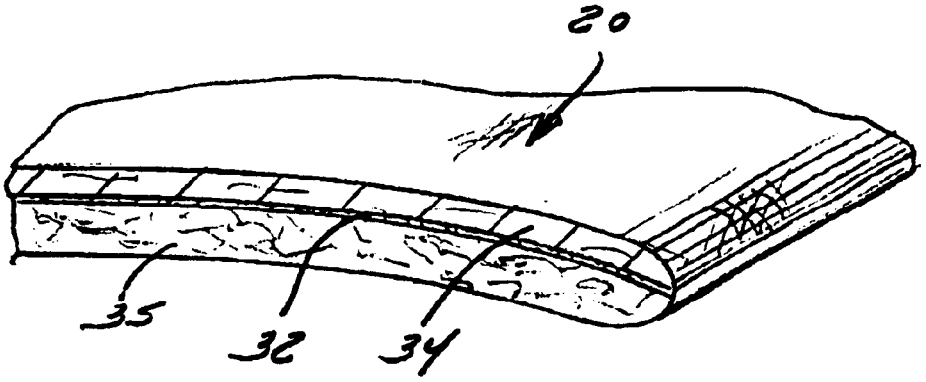
FIG. 8B is a fragmentary perspective view of the end of a slat and illustrating another edge finish.

The laminate may then be slit into strips having a width equal to the arc length of illustrated slats 20. These strips are then placed in a mold having the crowned shape of slat 20 and heated once again to soften the polymer matrix 35 (and adhesive 32) for a time sufficient to allow the strip to assume the cross-sectional shape of slat 20. The strip is then cooled below the softening temperature of polymer matrix 35 and adhesive 32, whereafter the strip is removed from the mold. Any required secondary operations are then performed to produce slat 20. Two trimmed edge treatments are shown in FIGS. 8A and 8B and may be obtained using ultrasonic slitting or otherwise heat finishing the edge.

An alternative method includes using felt batt 30, a hot-melt adhesive web 32, and fabric 34 in rolls of large diameter and of a width slightly larger or the same as that of the arc length of a cross section of slat 20. The three strips of material are then fed to a processing machine which applies heat and pressure to the moving sandwich of material and uses forming rolls which create the crowned shape of slat 20. Pressure is maintained on the laminate while the temperature is raised to the desired melting point of low-melt fibers 31 and the adhesive 32, and the forming rolls remains on the laminate while the polymer matrix 35 is cooled (e.g., by water cooled rolls). After cooling, slat 20 is run through a slitter to trim the edges, is cut to length, and is finished, stacked or packaged.

Alternatively, slit widths of pre-laminated fabric may be formed continuously with heated rollers, profiled to the appropriate slat shape, then cooled.

In any of the above methods, and in any of the variations of them which will be apparent to those of skill in the art, the adhesive 32 may be the same material as low-melt fibers 31.

Slat 20, manufactured as described above, is resilient and relatively tolerant of abuse. If folded over upon itself, it does not fracture as a wood or fully plasticized slat would, but creases in a manner similar to that of a metal slat. Slat 20 differs however from prior art slats in that it may be easily repaired by application of heat, e.g. using a conventional household clothes pressing iron or the like.

FIG. 5 is provided to show another example of a slat configuration which falls within the scope of this invention, namely an S-shaped slat 120. In this product the slat base is illustrated at 122, the adhesive at 132 and the fabric layer at 134. The polymer matrix 135 and the at least partially enveloped high melt fibers 133 are also illustrated. All processing steps discussed above would be applicable, except that the shape of the mold or forming rolls would be reconfigured for the S-shape illustrated.

FIG. 6 shows a curled edge configuration for a slat 140. The slat base is illustrated at 142, the adhesive at 144, the fabric layer at 146. The polymer matrix 148 and at least partially enveloped high melt fibers 149 are also illustrated. The shaping of the slats 140 could be accomplished using suitable molds. This configuration is particularly useful for light control stacking and the amount and shape of the curl can be varied widely.

FIG. 7 shows an important embodiment of the invention, where a slat 220 is created by simply heating and compressing a felt batt 30, i.e. without applying an adhesive layer 32 or a fabric layer 34 thereto. The polymer matrix 235 at least partially envelopes high-melt fibers 233 to produce a surface which may, if necessary, be printed, painted or otherwise decorated for use as a slat for a window covering. The shape of the slat (e.g. rectangular, S-shaped, curled or any other cross-sectional configuration) may vary to the same extent as the laminated structures described in connection with the earlier FIGURES, and the methods of manufacture mentioned above may also be used for this embodiment.

While the embodiments illustrated in the FIGURES and described above are presently preferred, it should be understood that these embodiments are offered only as examples. Other variations will become obvious to those skilled in the art after they have read the specification but are nonetheless within the scope and spirit of the present invention. The invention is therefore not to be limited to any particular embodiment, but encompasses various modifications and differences of construction that fall within the scope and spirit of the appended claims.

What is claimed is:

1. A window covering comprising a plurality of substantially rigid slats, each slat including a slat base comprising a polymer and a plurality of fibers at least partially enveloped thereby and a fabric layer secured to the slat base, wherein the melting point of the polymer is lower than the melting point of the plurality of fibers.

2. The window covering of claim 1, wherein the slat base includes randomly oriented strands of said fibers.

3. The window covering of claim 1, wherein the polymer of the slat base comprises randomly oriented strands.

4. The window covering of claim 3, wherein the polymer and the fibers are each thermoplastic resins.

5. The window covering of claim 1, wherein an adhesive bonds the fabric layer to the slat base.

6. The window covering of claim 1 wherein the fabric layer is bonded to the slat base.

7. The window covering of claim 5 wherein the adhesive is a hot-melt adhesive.

8. The window covering of claim 5 wherein the adhesive is the same material as the polymer.

9. The window covering of claim 1, wherein the slat is curved in transverse cross-section.

10. A slat for a window covering comprising a, substantially rigid slat base of a polymer matrix including a plurality of fibers and a fabric layer secured to the slat base, wherein the melting point of, a polymer of the polymer matrix is lower than the melting point of the plurality of fibers.

11. The slat of claim 10, wherein the slat base includes randomly oriented strands of said fibers.

12. The slat of claim 10 having an edge selected from the group of edges comprising an ultrasonic slit edge and a heat finished edge.

13. The slat of claim 11, wherein the polymer matrix of the slat base comprises randomly oriented strands of a first polymer.

14. The slat of claim 13, wherein the polymer matrix and the fibers are each thermoplastic resins.

15. The slat of claim 10 further including an adhesive between the slat base and the fabric.

16. The slat of claim 15 wherein the adhesive is a hot-melt adhesive.

17. The slat of claim 15 wherein the adhesive is the same material as, a polymer of the matrix.

18. The slat of claim 16, wherein the fabric layer is bonded to the slat base.

19. A window covering comprising:

a head rail operatively supporting a plurality of, substantially rigid slats, each slat including a plurality of first fibers at least partially enveloped in a polymer formed from a plurality of second fibers having a melting point lower than the plurality of first fibers.

20. The window covering of of claim 19 wherein the polymer and the, first fibers are each thermoplastic resins.

21. The window covering of claim 19 wherein each slat is decoratively finished by printing on a surface thereof.

* * * * *